US010537777B1

(12) United States Patent
Tash et al.

(10) Patent No.: US 10,537,777 B1
(45) Date of Patent: Jan. 21, 2020

(54) COMPOSITE DISCUS

(71) Applicant: Litania Sports Group, Inc., Champaign, IL (US)

(72) Inventors: Shevket E. Tash, Urbana, IL (US); Gregory W. Luebbering, Heyworth, IL (US)

(73) Assignee: Litania Sports Group, Inc., Champaign, IL (US)

( * ) Notice: Subject to any disclaimer, the term of this patent is extended or adjusted under 35 U.S.C. 154(b) by 148 days.

(21) Appl. No.: 15/898,465

(22) Filed: Feb. 17, 2018

(51) Int. Cl.
*A63B 65/10* (2006.01)
*A63B 21/06* (2006.01)
*A63B 69/36* (2006.01)

(52) U.S. Cl.
CPC ..... *A63B 65/10* (2013.01); *A63B 21/06* (2013.01); *A63B 69/3688* (2013.01); *A63B 2209/02* (2013.01)

(58) Field of Classification Search
CPC ..... A63B 21/06; A63B 65/10; A63B 37/12; A63B 37/14
USPC ..... 473/588, 589; 446/46, 47, 48
See application file for complete search history.

(56) References Cited

U.S. PATENT DOCUMENTS 1,006,628 A * 10/1911 Burr ..... A63B 65/10 482/21
1,492,976 A 5/1924 Gill
1,570,185 A * 1/1926 Reach ..... A63B 65/10 482/21
2,223,091 A * 11/1940 Bresnahan ..... A63B 65/10 482/21
2,864,201 A * 12/1958 Leise ..... A63B 65/10 446/46
5,522,780 A 6/1996 Roddy
6,241,570 B1 * 6/2001 Thorne, III ..... A63B 65/10 441/136
8,979,680 B2 * 3/2015 Hudack, III ..... A63B 67/00 473/415

OTHER PUBLICATIONS

Article: Embedding Carbon Fibre structures in metal matrixes for additive manufacturing published: 2017 retrieved: Oct. 7, 2019 (Year: 2017).*

* cited by examiner

*Primary Examiner* — Megan Anderson
(74) *Attorney, Agent, or Firm* — Philip L. Bateman

(57) ABSTRACT

A discus has a top plate formed of a perforated aluminum sheet fused with carbon fiber, a bottom plate formed of a perforated aluminum sheet fused with carbon fiber, a weighted spool between the top plate and the bottom plate, and a ring connecting the top plate to the bottom plate.

4 Claims, 4 Drawing Sheets

COMPOSITE DISCUS

FIELD OF THE INVENTION

This invention relates to exercise. More particularly, this invention relates to track and field. Still more particularly, this invention relates to the discus.

BACKGROUND OF THE INVENTION

Track and field is a sport in which athletes compete in running, jumping, and throwing. One of the throwing events is the discus throw. In this event, athletes attempt to throw the discus a maximum distance into a restricted landing area with a forehand sidearm movement. The discus throw has been a common track and field event since the original Olympic games of the ancient Greeks.

The discus is a heavy disc having a generally convex top surface, a generally convex bottom surface, and a smooth rim. The size and weight of the discus for various classes of athletes is set by track and field governing bodies. For example, the discus thrown by adult men is 22 centimeters (7.1 inches) in diameter and has a weight of 2 kilograms (4.4 pounds).

Although the size and weight of the discus is specified, the material of construction and the weight distribution is variable. A conventional discus is typically made of four parts: a top plate, a symmetrical bottom plate, a metal rim around the outer edges of the plates, and an interior weight. The interior weight typically has the shape of a spool with female threaded openings at the top and bottom to receive top and bottom screws that hold the assembly together. The top and bottom plates are typically made of plastic, hard rubber, wood, fiberglass, or carbon fiber. The top and bottom plates are sometimes coated with a thin gel. A common problem with conventional discuses is that the top and bottom plates are prone to cracking after repeated use.

Gill, U.S. Pat. No. 1,492,976, May 6, 1924, discloses a discus with a threaded metal rim. Roddy, U.S. Pat. No. 5,522,780, Jun. 4, 1996, discloses a discus with an asymmetrical weight distribution. Neither the Gill discus nor the Roddy discus has top plates with greater durability.

Accordingly, there is a demand for an improved discus. More particularly, there is a demand for a discus having top plates and bottom plates of greater durability.

SUMMARY OF THE INVENTION

The general object of this invention is to provide an improved discus. A more particular object is to provide a discus having a top plate and a bottom plate of greater durability.

We have invented an improved discus. The discus comprises: (a) a circular top plate with an outer edge, the bottom plate formed of a metal sheet fused with carbon fiber; (b) a circular bottom plate with an outer edge, the bottom plate formed of a metal sheet fused with carbon fiber; (c) a weighted spool sandwiched between the top plate and the bottom plate; and (d) a metal rim connecting the outer edge of the top plate to the outer edge of the bottom plate.

The discus of this invention has a top plate and a bottom plate of greater durability.

DETAILED DESCRIPTION OF THE INVENTION

Figure 1:
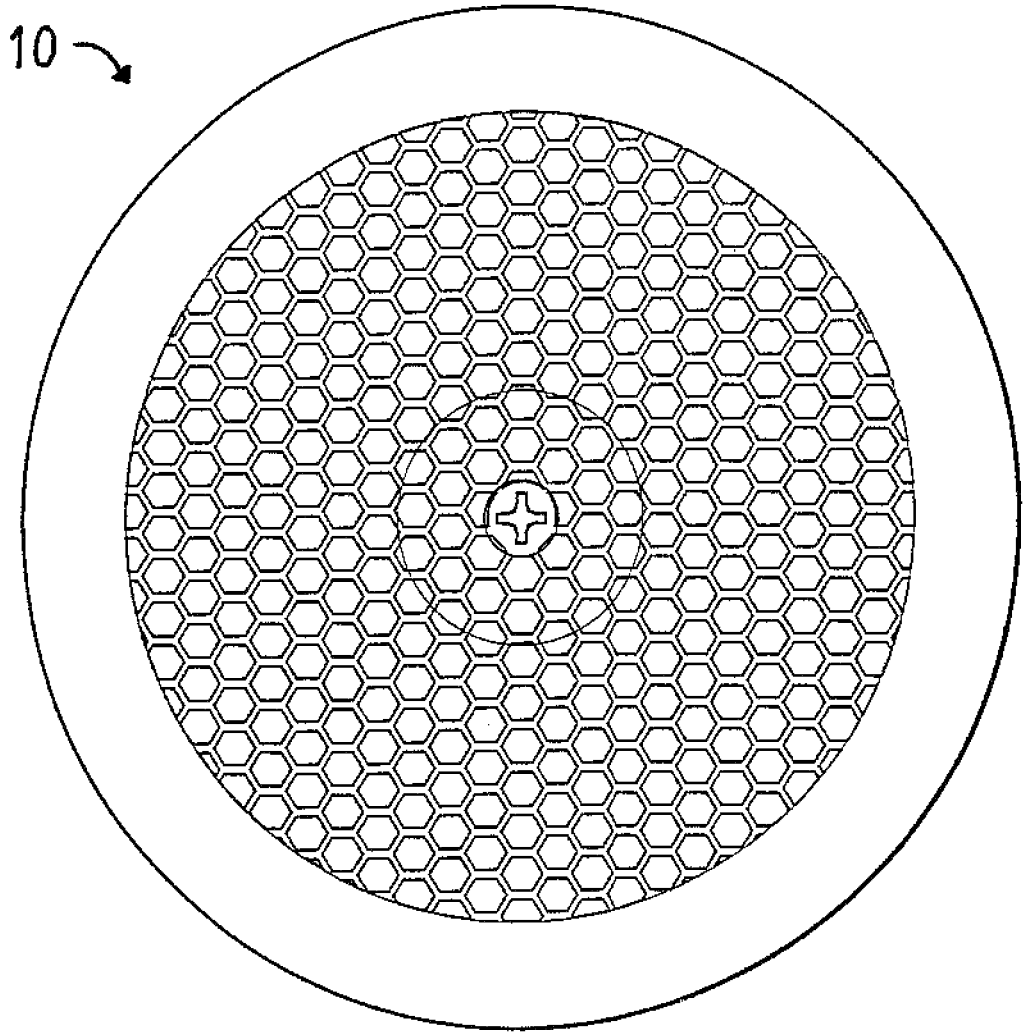
FIG. 1 is a top plan view of a preferred embodiment of the discus of this invention.
Figure 2:
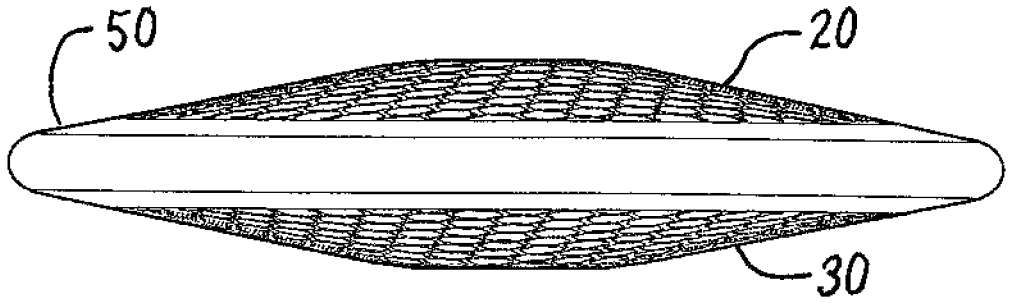
FIG. 2 is a side elevation view thereof.
Figure 3:
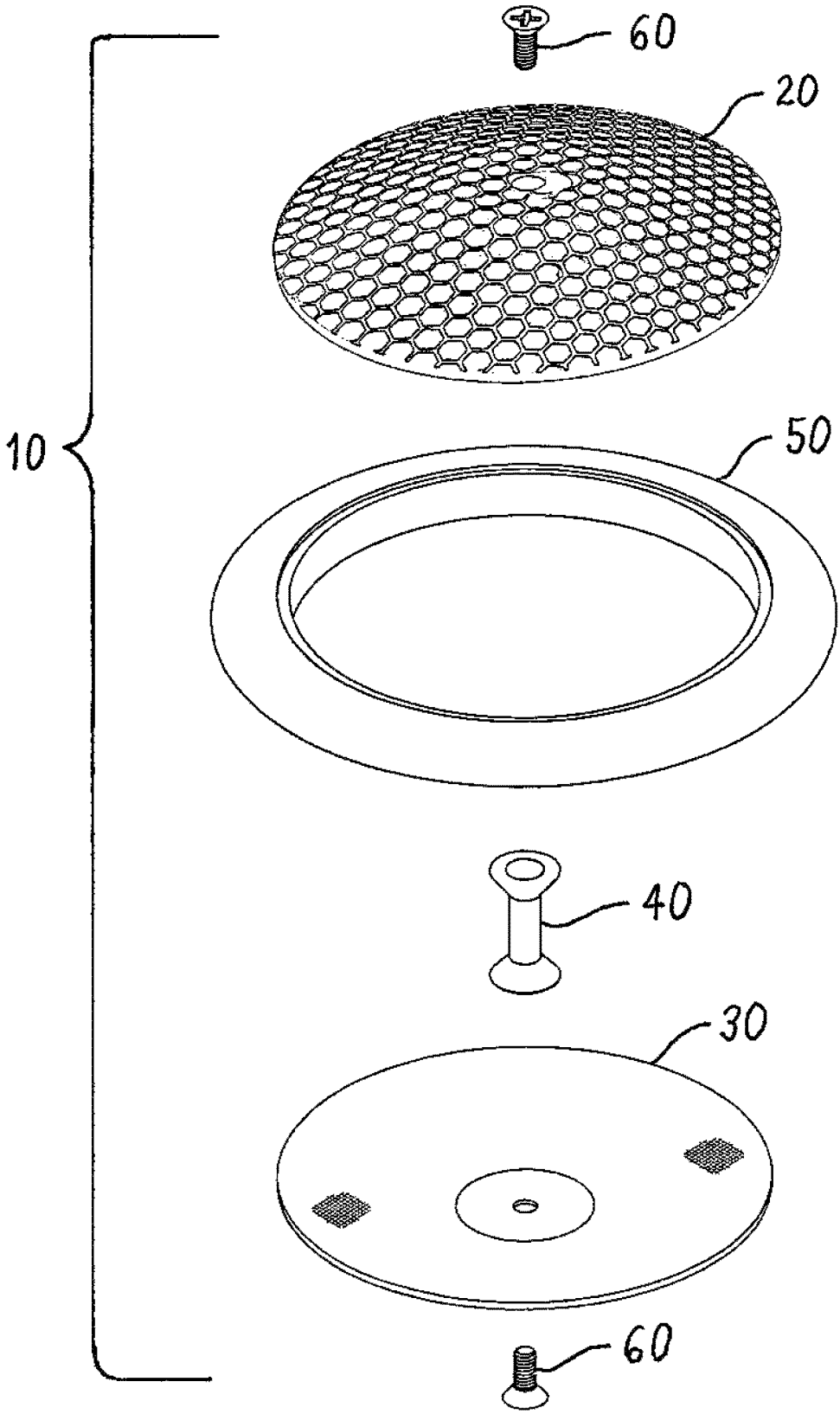
FIG. 3 is an exploded perspective view thereof.

This invention is best understood by reference to the drawings. Referring to FIGS. 1 to 3, a preferred embodiment of the discus 10 of this invention has a top plate 20, a bottom plate 30, a weighted spool 40, a rim 50, and fasteners 60. The components of the discus are discussed in more detail below.

Figure 4:
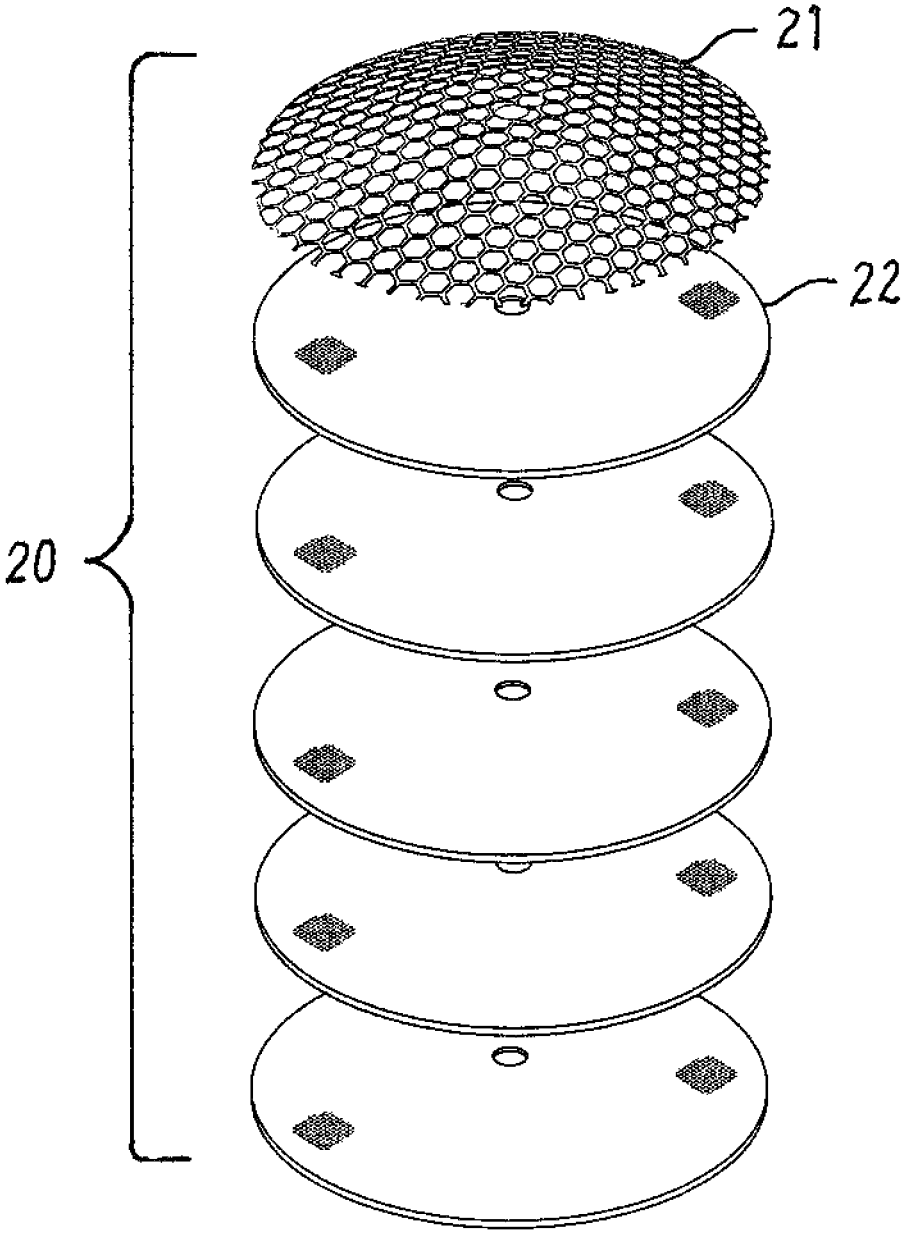
FIG. 4 is an exploded perspective view of the manufacture of a plate.
Figure 5:
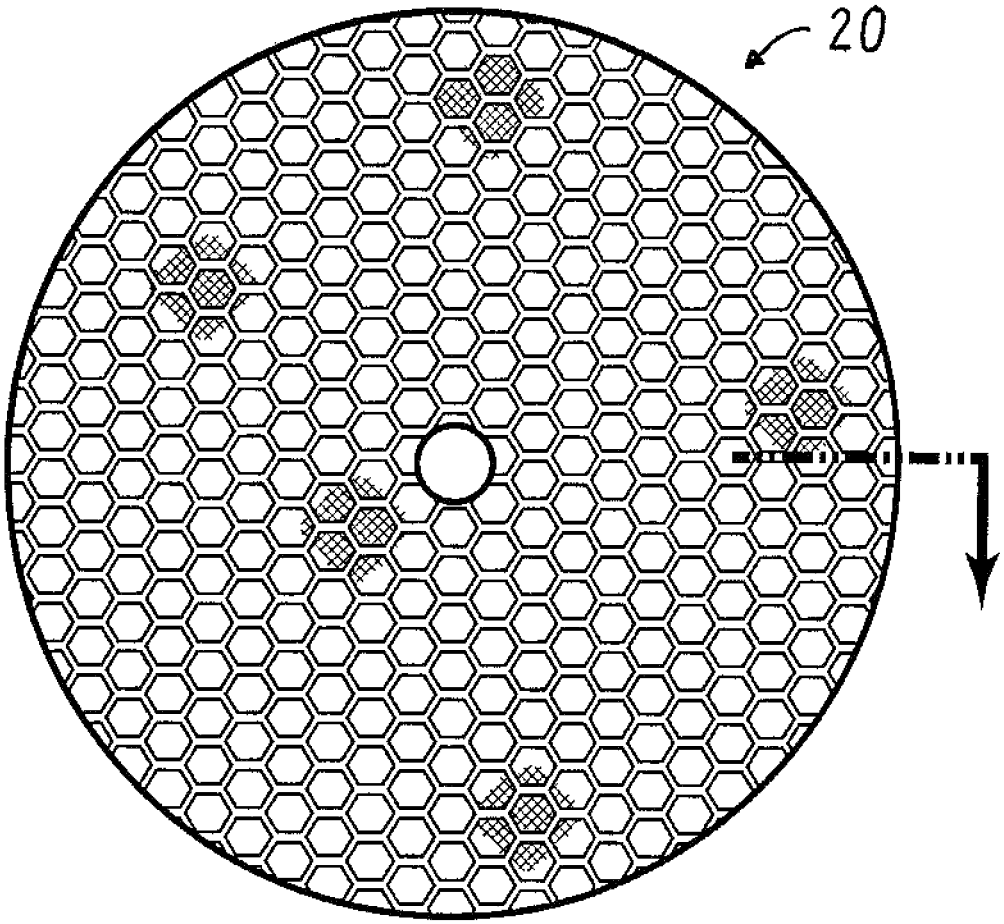
FIG. 5 is a top view of a plate.
Figure 6:
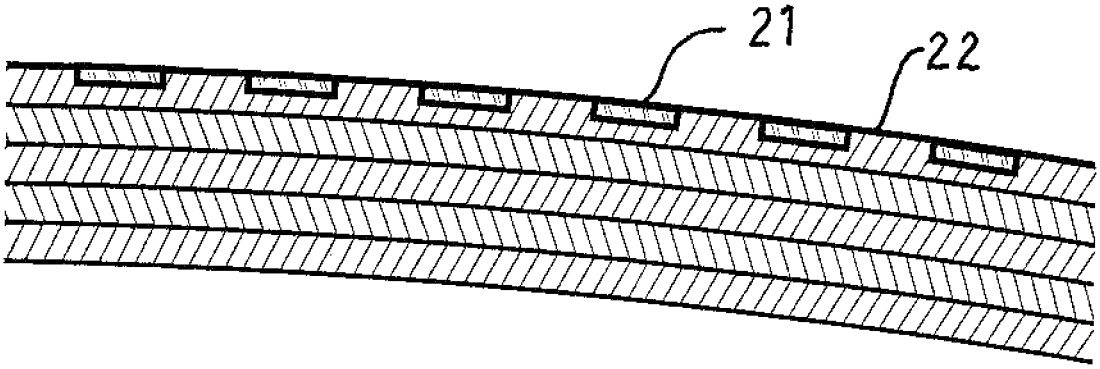
FIG. 6 is a detailed sectional view thereof taken along the line in FIG. 5.

Referring now to FIG. 4, the top plate 20 is a metal sheet 21 fused with carbon fiber, generally in the form of multiple sheets 22. The top plate and the bottom plate are identical or similar in construction so only the top plate is described. The top plate is manufactured by placing the metal sheet and carbon fiber into a mold. The mold is then subjected to extreme heat and pressure, preferably about 280° F. and about 40 pounds per square inch for about forty-five minutes, to form a composite. Unless otherwise indicated expressly or by context, the term "about" is used herein to mean plus or minus 25 percent of the measurement or other quantified property referenced. The metal sheet in the resulting top plate is flush in the carbon fiber so the top plate is completely smooth to the touch. The upper, outer surface of the top plate is left unfinished, painted, or otherwise finished as desired. The shape and dimensions of the top plate are matters of choice that depend on the desired shape and size of the discus. The top plate is generally circular and convex (bowed) with either a continuous curve or a series of relatively flat portions. As best seen in FIG. 2, the preferred top plate has a generally flat circular inner portion and an angled annular portion.

The metal sheet of the top plate is preferably perforated to form a lattice. The perforated metal sheet provides a surprising increase in strength to the carbon fiber while adding only minimal additional weight. Preferred metals are light in weight, strong, and malleable and include aluminum, copper, tin, alloys thereof, and the like. Aluminum is the most preferred metal because of its superior physical properties and relatively low cost. A preferred perforated aluminum sheet is model 92725T42 sold by McMaster-Carr Supply Company of Elmhurst, Ill. This sheet is perforated with hexagonal openings and has a weight of 0.02 ounces per square inch.

As previously described, the carbon fiber is generally added to the mold in the form of sheets forming multiple layers. A preferred carbon fiber sheet is model T300 manufactured and sold by Cytec Solvay Group of Woodland Park, N.J. Five to ten sheets of this carbon fiber are generally used. The preferred number is determined by the desired weight.

The weighted spool 40 is conventional and is best seen in FIG. 3. The weighted spool is typically made of metal and sandwiched between the top plate and bottom. The weighted spool is generally secured in position with fasteners and/or adhesives. In the preferred embodiment shown, the weighted spool has female threaded openings at the top and bottom to receive top and bottom screws 60 that hold the discus assembly together.

The rim 50 is conventional and is best seen in FIG. 3. The rim is typically made of steel. The rim typically has inner ledges along its top and bottom surfaces to accept the top and bottom plates. The rim is thus attached to the outer edge of the top plate and to the outer edge of the bottom plate.

The discus is used in a conventional manner. Testing of the discus has revealed a surprising increase in durability. The top plate and bottom plate have shown no signs of cracking despite multiple throws.

We claim:

1. A discus comprising:

(a) a circular top plate with an outer edge, the circular top plate formed of a perforated aluminum sheet fused with carbon fiber;

(b) a circular bottom plate with an outer edge, the circular bottom plate formed of a perforated aluminum sheet with carbon fiber;

(c) a weighted spool sandwiched between the circular top plate and the circular bottom plate, the weighted spool having a top female threaded opening and a bottom female threaded opening;

(d) a top fastener passing through the circular top plate and into the top female threaded opening of the weighted spool;

(e) a bottom fastener passing through the circular bottom plate and into the bottom female threaded opening of the weighted spool; and (f) a metal rim attached to the outer edge of the circular top plate and to the outer edge of the circular bottom plate.

2. The discus of claim 1 wherein the perforated aluminum sheets fused with carbon fiber of the circular top and bottom plates comprise a plurality of carbon fiber sheets.

3. A discus comprising:

(a) a top plate formed of a perforated aluminum sheet fused with carbon fiber;

(b) a bottom plate formed of a perforated aluminum sheet fused with carbon fiber; and (c) a ring attached to the top plate and to the bottom plate.

4. The discus of claim 3 wherein the perforated aluminum sheets fused with carbon fiber of the circular top and bottom plates comprise a plurality of carbon fiber sheets.

* * * * *